United States Patent [19]

Johnson

[11] 4,307,803

[45] Dec. 29, 1981

[54] DISPLAY STRUCTURE

[75] Inventor: Fred J. Johnson, Long Beach, Calif.

[73] Assignee: Container Corporation of America, Chicago, Ill.

[21] Appl. No.: 170,704

[22] Filed: Jul. 21, 1980

[51] Int. Cl.[3] ..... B65D 5/50

[52] U.S. Cl. ..... 206/45.19; 206/321; 206/491; 206/45.34

[58] Field of Search ..... 206/45.34, 45.19, 45.14, 206/321, 491

[56] References Cited

U.S. PATENT DOCUMENTS 2,374,006 4/1945 Freel et al. ..... 206/45.19
3,108,685 10/1963 De Vines ..... 206/321
3,185,296 5/1965 Sohlage ..... 206/321
3,326,362 6/1967 Smith et al. ..... 206/321
3,533,503 10/1970 Wood et al. ..... 206/45.19

*Primary Examiner*—William T. Dixson, Jr.
*Attorney, Agent, or Firm*—R. W. Carpenter; Davis Chin

[57] ABSTRACT

A display structure comprising a base panel with first and second over panels hingedly connected at opposite ends of the base panel and foldable into position over the base panel, one of the over panels being connected to a platform structure consisting of opposed end and side walls with a central panel therebetween spaced above the over panels.

4 Claims, 4 Drawing Figures

DISPLAY STRUCTURE

SUMMARY OF THE INVENTION

The invention structure is designed to display merchandise particularly in those instances where the merchandise is protected by a clear resinous blister or shell, although the structure is not so limited to being part of a so-called blister pack. The invention structure lends itself also to the display of merchandise suspended from display racks, and known in the trade as visual carded packaging.

THE DRAWINGS

DESCRIPTION OF THE INVENTION

Figure 2:
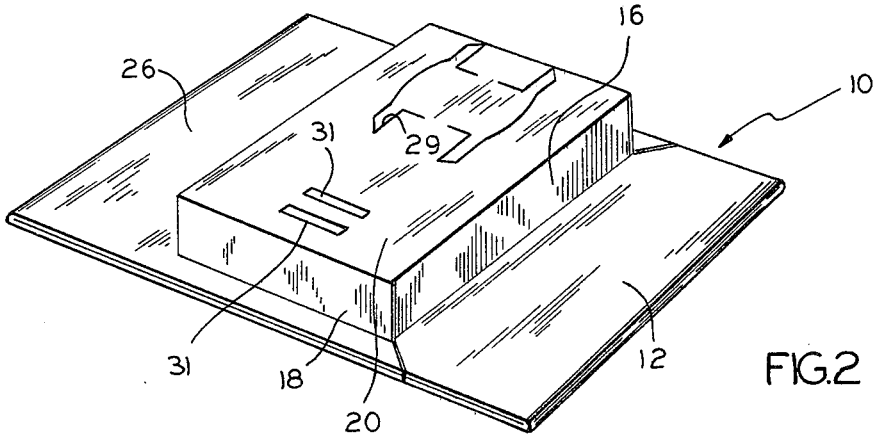
FIG. 2 is a perspective view showing the invention structure.
Figure 4:
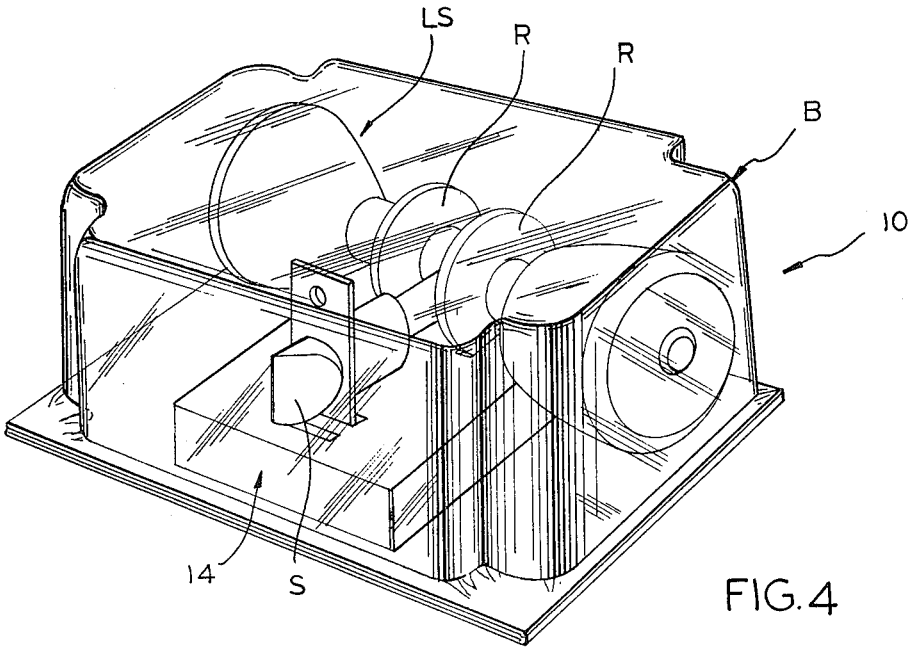
FIG. 4 is a perspective view of the structure of FIG. 2 with an article of commerce displayed thereon and enclosed within a clear resinous blister.

The display structure according to the present invention is denoted by reference numeral 10 and is formed from a cut and scored blank 10A. When the latter is erected as seen in FIGS. 2 and 4 it may be for the purpose of displaying a lockset LS comprised of escutcheons or roses R and a strike S. The structure 10 is adapted to support a blister B of transparent resinous material secured thereto in any convenient manner.

Blank 10A includes a base panel 11 having a first over panel 12 hinged thereto along a fold line 13. A platform structure 14 is formed from blank 10A and includes opposed side walls 16, one of the side walls 16 being foldably connected to first over panel 12 along fold line 17, and the other side wall 16 remote from said first over panel 12 having a glue flap 19 folded thereto along a fold line 21. Opposed end walls 18 are provided with tuck flaps 24 foldable with respect to end walls 18 along fold lines 25. The opposed side walls 16 and the opposed end walls 18 are foldable with respect to a central panel 20, the side walls 16 and central panel 20 having a length preferably less than the width of over panel 12. Walls 16 are foldable with respect to central panel 20 along fold lines 22.

Dust flaps 23 are provided at the ends of side walls 16 and are foldable into position against end walls 18 along extensions of the fold lines 22.

A second over panel 26 is foldable with respect to bottom panel 11 along a fold line 27, and the distal end of panel 12 is notched as at 30 to register with tangs 30A at the distal end of panel 26. By reason of tangs 30A at the distal edge of panel 26 a full length line of weakness is avoided where panel 26 is joined to base panel 11.

Figure 1:
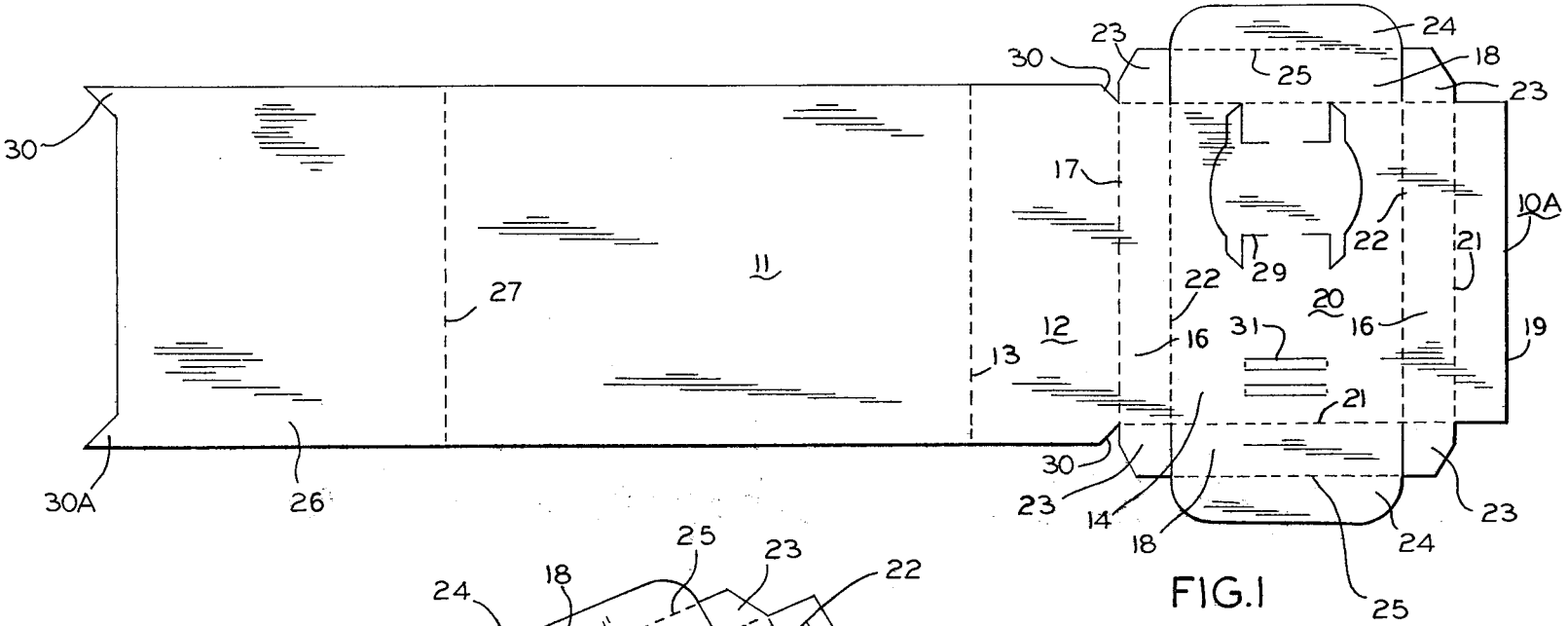
FIG. 1 is a plan view of a cut and scored blank for forming a display structure according to the present invention.
Figure 3:
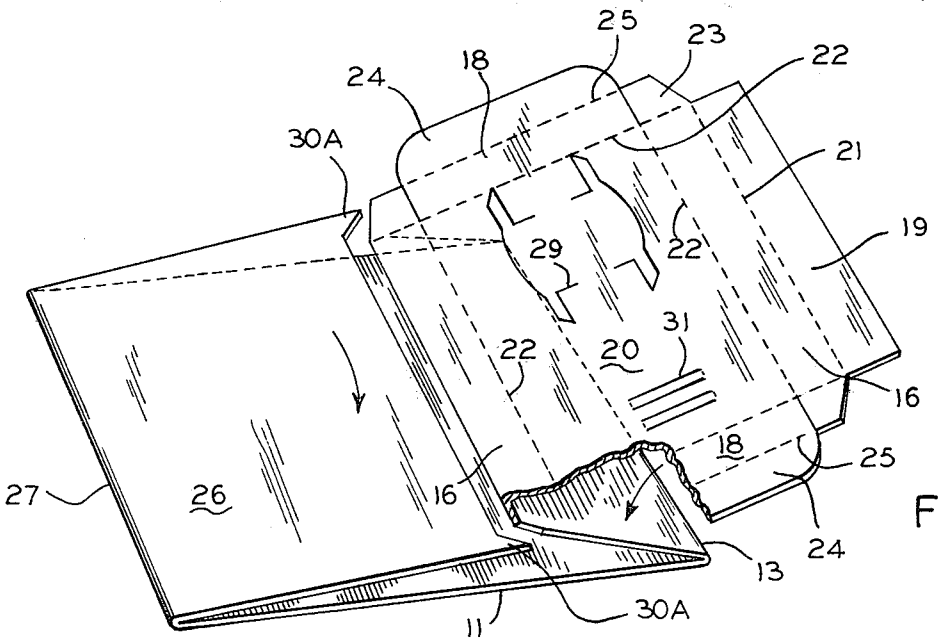
FIG. 3 is a perspective view showing a step in the forming of the structure of FIG. 2.

As seen in FIG. 3, over panel 26 is folded against bottom panel 11 and adhered thereto. Over panel 12 is then folded against bottom panel 11 and adhered thereto. Central panel 20 is placed in spaced relationship to over panels 12 and 26 and over the same, the side walls 16 being erected with flap 19 of one of side walls 16 adhered to second over panel 26.

The dust flaps 23 and tuck flaps 24 are folded to position as seen in FIGS. 2 and 4.

Central panel 20 is provided with cutouts 29 and 31 to position the lockset LS on platform 14 at its escutcheon or roses R and strike S.

The length of platform structure 14 is somewhat less than the width of panels 11, 12 and 26, so that the blister B can be accommodated on panels 12 and 26 at the ends of platform structure 14, as seen in FIG. 4, to enclose the lockset LS.

I claim:

1. In a display structure for packaging, said structure being formed from a cut and scored blank of paperboard or the like, and comprising:

(a) a base panel;

(b) a first over panel hingedly connected to said base panel at one end thereof and folded into position overlying a first portion of said base panel;

(c) a platform structure connected to said first over panel and comprising opposed side and end walls with a central panel therebetween spaced above said base panel;

(d) a second over panel hingedly connected to said base panel at the other end thereof and folded into position overlying the remaining portion of said base panel;

(e) a glue flap hingedly connected to a side panel remote from said first over panel and adhered selectively to said second over panel and said bottom panel; and (f) tuck flaps foldably joined to said end walls and being disposed in position overlying said second over panel.

2. A display structure according to claim 1 wherein said first and second over panels are adhered to said base panel.

3. A display structure according to claim 1 wherein said central panel has a length less than the width of said first over panel.

4. A display structure according to claim 1, wherein said first over panel has notches at its distal end, and said second over panel is provided with tangs at its distal end to register with the notches.

* * * * *